United States Patent [19]

Fey

[11] 4,247,732

[45] Jan. 27, 1981

[54] METHOD AND APPARATUS FOR ELECTRICALLY FIRING AN IRON BLAST FURNACE

[75] Inventor: Maurice G. Fey, Plum, Pa.

[73] Assignee: Westinghouse Electric Corp., Pittsburgh, Pa.

[21] Appl. No.: 68,855

[22] Filed: Aug. 21, 1979

[51] Int. Cl.[3] ..... H05H 1/24; H05B 7/00

[52] U.S. Cl. ..... 13/2 P; 13/9 R; 266/197

[58] Field of Search ..... 13/2 R, 2 P, 9 R; 266/197; 219/121 P

[56] References Cited

U.S. PATENT DOCUMENTS

| | | | |
|---|---|---|---|
| 3,663,792 | 5/1972 | Fey . | |
| 3,702,182 | 11/1972 | Leyshon | 13/2 X |
| 4,013,867 | 3/1977 | Fey . | |
| 4,097,028 | 6/1978 | Langhammer | 266/197 X |
| 4,129,742 | 12/1978 | Ward | 13/2 P |
| 4,153,426 | 5/1979 | Wintrell | 266/197 X |

*Primary Examiner*—Roy N. Envall, Jr.
*Attorney, Agent, or Firm*—L. P. Johns

[57] ABSTRACT

A blast furnace for reducing iron ore characterized by a vertical tubular refractory shell forming an upper reduction zone and a lower hearth which shell is adapted to contain a charge of iron ore and ore reductance, at least one arc heater mounted on the shell and extending therethrough for injecting an arc heated mixture of gas containing carbon monoxide into the reduction zone.

12 Claims, 4 Drawing Figures

METHOD AND APPARATUS FOR ELECTRICALLY FIRING AN IRON BLAST FURNACE

BACKGROUND OF THE INVENTION

1. Field of the Invention

This invention relates to a blast furnace for reducing ore to a metal and, more particularly, it pertains to an electric arc heater heating means therefor.

2. Description of the Prior Art

The rapidly rising price of metallurgical coke has induced the basic steel industry to consider a potential for electrically firing iron-making blast furnaces. The phenomenon is particularly attractive for steel producers which have customarily relied upon purchased coke and are located in regions of stable electricity costs and have available sources of lower cost reductant, such as natural gas, oil, and the like.

SUMMARY OF THE INVENTION

In accordance with this invention an iron blast furnace and method for operation thereof is provided and comprises a blast furnace for reducing iron ore to elemental metal comprising a vertical tubular refractory shell forming an upper reduction zone and a lower hearth, the shell being adapted to contain a charge of iron ore and ore reactants, means for injecting a gaseous mixture into the zone and comprising at least one arc heater, the arc heater having axially spaced, generally cylindrical electrodes forming a narrow gap therebetween and adapted to be connected to a source potential to produce an arc therein, the electrodes forming an arc chamber and one of the electrodes extending through the refractory shell and communicating the arc chamber with said zone, gas inlet means communicating with the gap for introducing through the gap a reducing gas selected from the group consisting of hydrocarbon gas, liquid petroleum gas, and mixtures thereof, into the arc chamber to form an arc-heated gas stream, second gas inlet means for introducing a quantity of oxygen-containing gas into the arc-heated gas stream in an amount generally equal to a stoichiometric mixture with reducing gas and the ore reductants to produce a maximum amount of carbon monoxide to effect reduction of the metal ore to the elemental metal, there being three cylindrical electrodes with a narrow gap between each adjacent pair of electrodes, the upstream and downstream electrodes being grounded and the intermediate electrode being connected to an electric potential, and the second gas inlet means comprising a gas-swirling structure communicating with the upstream end of the arc chamber to effect a spiral-like motion of the gas through the arc chamber, and the oxygen-containing gas being preheated to a temperature of about 500° to 1300° C.

The advantage of the device of this invention is that it significantly reduces blast furnace coke consumption by the injection of arc heater produced reformer gas comprising mixtures of CO, $H_2$, and $N_2$ which is heated to a temperature of from about 1800° to 2800° C. as it enters the blast furnace reduction zone.

DESCRIPTION OF THE PREFERRED EMBODIMENTS

Figure 1:
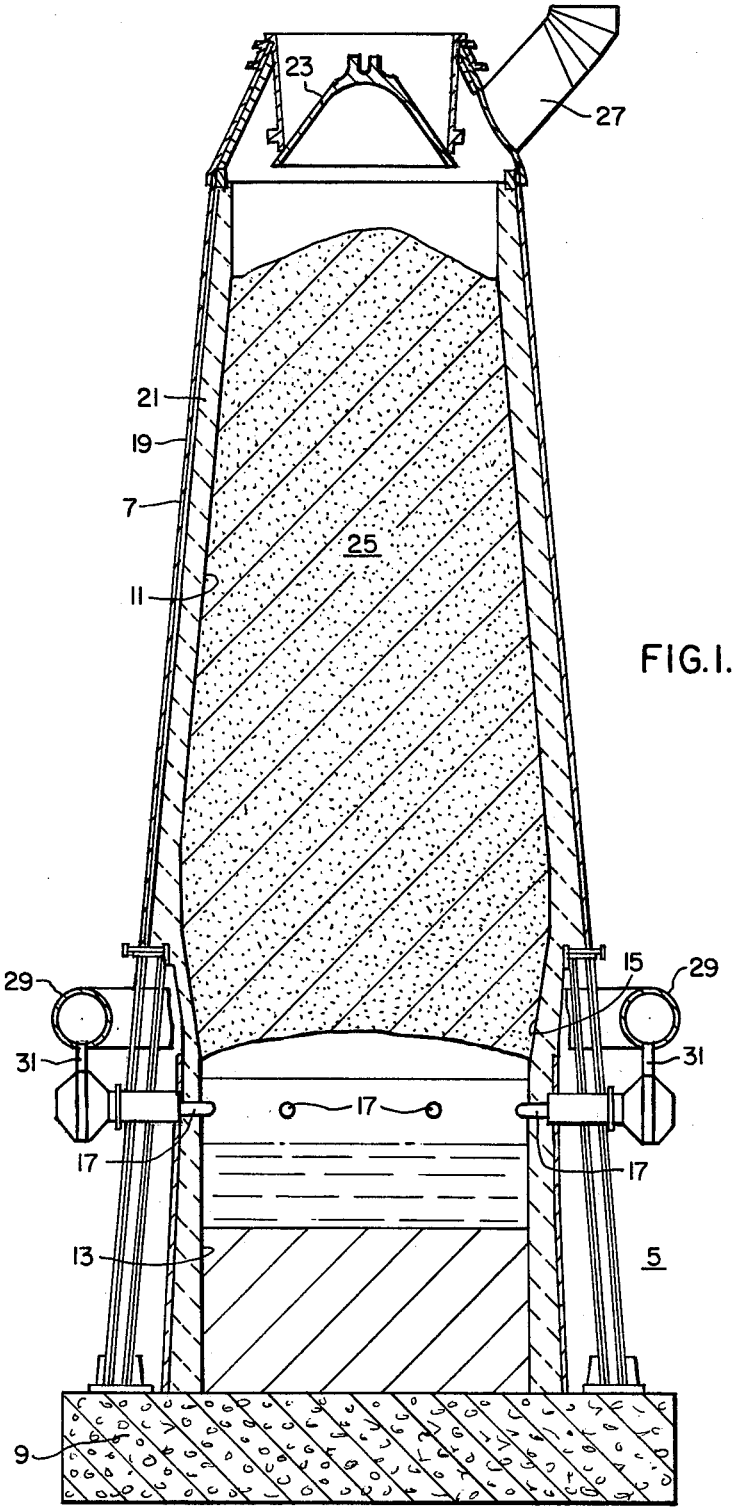
FIG. 1 is a vertical sectional view through a typical iron blast furnace.

In FIG. 1 an iron blast furnace, generally indicated at 5 comprises a vertical tubular shell 7 supported on a base 9 and providing an upper reduction zone 11 and a hearth 13. The furnace 5 also includes a bosh 15 intermediately the reduction zone 11 and the hearth 13 and which is the lower portion of the reduction zone where means, such as tuyeres 17, are disposed for introducing reducing gases into the furnace. The tubular shell 7 includes an outer wall 19 and a refractory lining 21. The upper portion of the shell 7 is tapered inwardly and upwardly and is closed at the upper end by a bell-shaped cover 23 through which a charge 25 is dumped into the furnace. Blast furnace gas exiting from the furnace moves through a gas outlet 27 from where it is conveyed through blast furnace accessories such as stoves. The charge 25 consists primarily of iron ore, limestone, and coke, which materials descend, in counterflow to the gases rising in the furnace, until they reach the bosh 15 which is the zone of highest temperature and maximum ore reduction to elemental metal which falls to the hearth 13 from where it is tapped from time to time.

The blast furnace 5 also includes a conduit 29 for delivering gas into the furnace through a plurality of the tuyeres 17 which are connected to the conduit or bustle pipe 29 by pipes 31, one pipe for each tuyere 17.

Although the blast furnace 5 is disclosed and described as being used for the reduction of iron ore to elemental iron, it is understood that the furnace or a similar furnace with some modifications may be used for the reduction of other ores of metals such as copper, lead, tin, and zinc.

In accordance with this invention an arc heater, generally indicated at 33 (FIG. 2) is provided at the location of each tuyere 17. The arc heater 33 is similar in construction and operation to the arc heater disclosed in U.S. Pat. No. 3,663,792, and due to the full disclosure in that patent a description of the arc heater 33 is limited herein to the basic structure and operation. The arc heater 33 is a single phase, self-stabilizing AC device capable of power levels to about 3,500 kilowatts, or up to 10,000 kilowatts for a three-phase plant installation such as shown in the embodiment of the invention shown in FIG. 4.

The arc heater 33 comprises three longitudinally spaced electrodes 35, 37, 39 between which annular gaps 41, 43, respectively, are disposed. The intermediate electrode 37 is connected to the electric potential and the downstream electrode 39 is grounded. The upstream electrode 35 is a so-called "guard" electrode which is likewise grounded is disposed between the potential electrode 37 and other structural portions of the blast furnace, such as a cyclone chamber 45, at the lower end of the pipe 31. Without the guard electrode 35 it would be necessary to provide complicated electrical and thermal insulating means between the electrode 37 and the cyclone chamber 45. Although such a construction is possible, thereby providing an arc heater 33 having only two electrodes 37, 39, it is expedient to provide the third guard electrode 35 which like the downstream electrode 39 is also grounded.

The axially aligned tubular electrodes 35, 37, 39 form an arc chamber 47 having an upstream opening 49 and a downstream outlet 51. The arc chamber 47 communicates with the cyclone chamber 45 into which oxygen containing gas, such as air, is introduced through the pipe 31 from the conduit 29 (FIG. 1) under pressure. The lower end of the pipe 31 communicates with the chamber 45 in an off-centered position so that as pressurized air from the conduit 29 enters the chamber 45 it is subjected to a swirling action, as indicated by the arrow 53, (FIGS. 2 and 3) before it enters the arc chamber 47, thereby forcing the air against the walls of the electrodes 35, 37, 39 and avoiding certain deposits such as carbon on the electrode wall.

Figure 2:
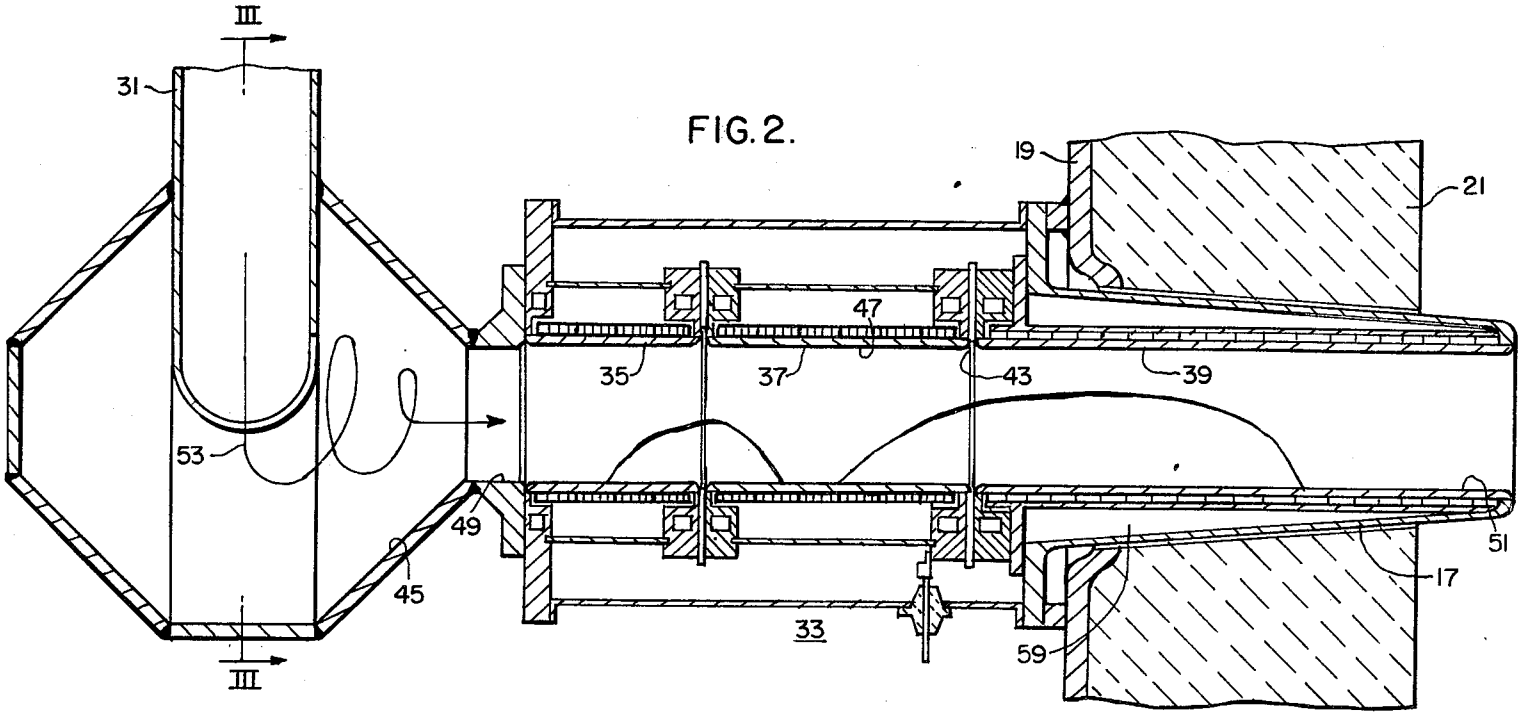
FIG. 2 is a vertical sectional view through a single-phase electric arc heater having a downstream electrode extending through the furnace lining in accordance with this invention.
Figure 3:
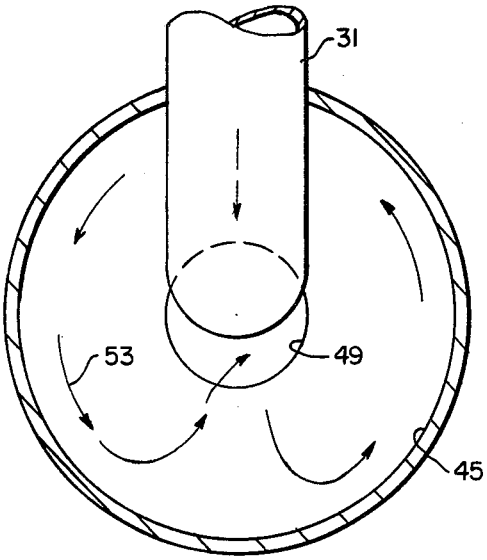
FIG. 3 is a vertical sectional view, taken on the line III—III of FIG. 2.

The annular gaps 41, 43 are connected to conduit means (not shown) for introducing a reducing gas into the arc chamber 47. The reducing gas is selected from a group consisting of hydrocarbon gas, liquid petroleum gas, and mixtures thereof. An example of a hydrocarbon gas is methane, $CH_4$. The gas is subjected to a pressure of about 2 to 10 bars, and may be preheated to a temperature of from about 20° to about 200° C. In response to the pressure of the gas entering through the gaps 41, 43, arcs 55, 57 are generated and elongated such as shown in FIG. 2.

For economic viability the reformer gas is preheated to a temperature of from about 500° to about 1300° C. in the blast furnace preheater stoves. Conventionally, externally fired reformers cannot be used because of a maximum operating temperature of about 900° to 1,00° C. Preheating to higher temperatures of the air and gas are avoided because of the problem of maintaining the integrity of the electrical insulation in the presence of such high temperature inlet gas.

In accordance with this invention the reformer gas is produced at the temperatures of between 1800° to 2800° F. as the gas mixes with the air and is heated by the arcs 55, 57. The reformer gas is generated from a mixture of air and a hydrocarbon, such as natural gas, which requires the addition of a substantial amount of energy, that is, about 76 K calories per mole of $CH_4$. The reaction is:

$$CH_4+2.38(0.21O_2+0.79N_2)\text{-}\rightarrow CO+2H_2+1.88N_2(+76K\ cal)$$

The energy requirement is estimated based on: (1) stoichiometric proportions, (2) $CH_4$ initial temperature—20° C., (3) air initial temperature—500° C., and (4) exit temperature—2400° C. The single-phase embodiment of the invention as shown in FIG. 2 comprises the elongated downstream electrode 39 which includes a cooling water jacket 59. It is directly insertable into and becomes part of the tuyere 17. The downstream electrode 39 is part of the three axially positioned tubular electrodes 35, 37, 39 which are separated by two insulating gaps 41, 43 through which the hydrocarbons, such as natural gas, is introduced at high velocity. The center electrode 37, being connected to a high voltage side of the power supply, functions with the two end electrodes 35, 39 which are connected to the ground terminal. Thus, both ends of the arc heater are connected to process equipment, the downstream electrode being connected to the blast furnace, and the upstream electrode to the inlet source of preheated air such as the conduit 29.

Figure 4:
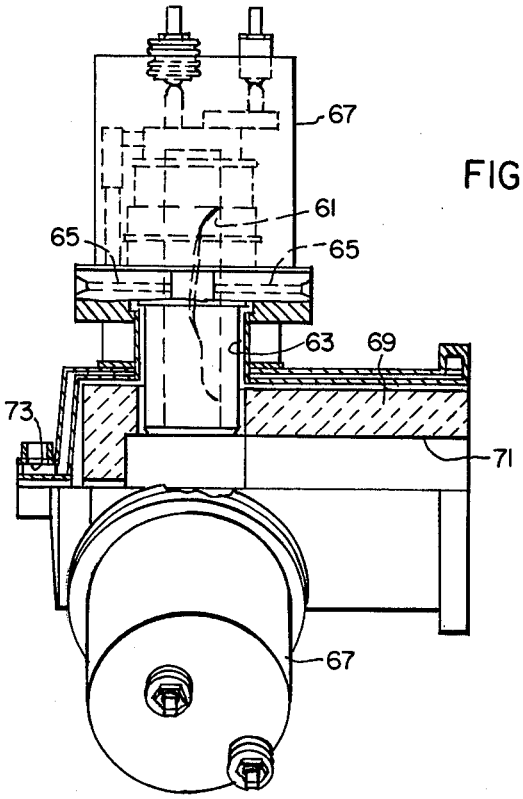
FIG. 4 is an elevational view, partly in section, showning the manner in which a three-phase arc heater assembly is used for introducing arc heated reducing gas into a blast furnace, as another embodiment of the invention.
Figure 2:
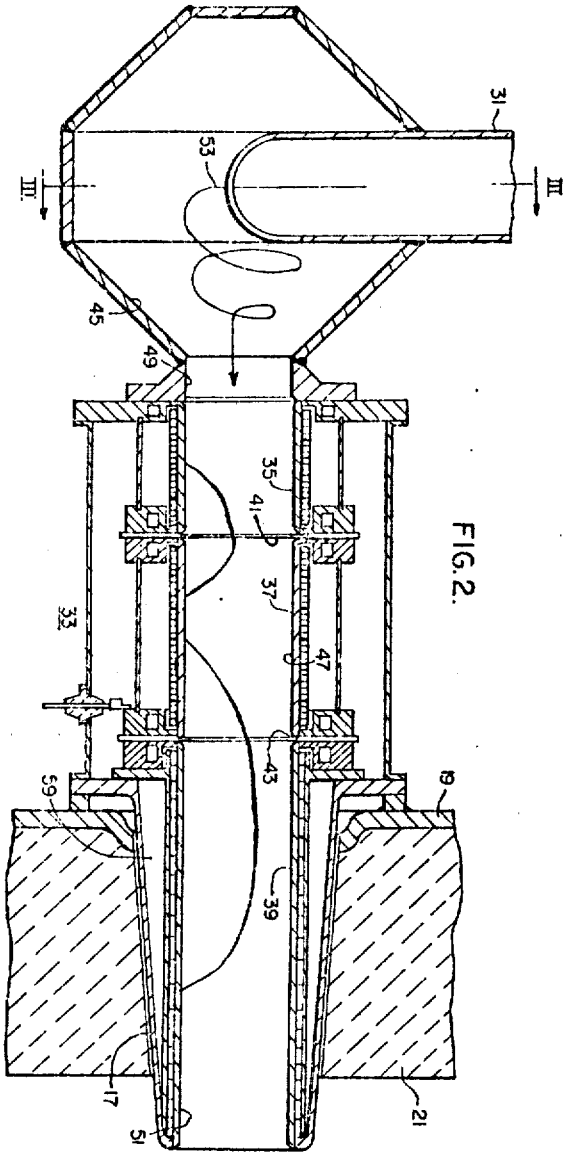

Another embodiment of the invention is shown in FIG. 4 in which a three-phase arc heater system is used for the production of reformer gas under the imposed conditions. In this embodiment three arc heaters having two axially disposed electrodes 61, 63 are separated by a gap 65 such as the gap 43 (FIG. 2). Each arc heater 67 of which two are shown in FIG. 4, is similar to that disclosed in the copending application, Ser. No. 32,326, filed Apr. 23, 1979 (W.E. Case 48,500). The arc heater 67 has the downstream electrodes 63 which are elongated and extend through a refractory wall 69 into a plenum chamber 71 which is axially aligned with an opening in the furnace wall, and may be used in conjunction with a conventional furnace tuyere such as the tuyere 17 (FIG. 2). Where the three-phase system is involved which uses the water cooled plenum chamber 71, air is introduced from the conduit 29 through an inlet 73, and the air mixes with the reformer gas within the chamber 71. The manner in which the three-phase system of arc heater 67 operates in generally disclosed in U.S. Pat. No. 4,013,867.

In a manner similar to the single-phase embodiment of FIG. 2, natural gas or other hydrocarbon gas, is injected through the gaps 65 in the three arc heaters 67 which mixes with the air in the chamber 71. The air entering the arc heaters is admitted at about 200° C. maximum, but represents only up to about 25% of the total air requirement, thus the deleterious effect on the process efficiency is small. The preheated air is admitted axially through the electrically grounded plenum chamber 71 where mixing and the subsequent chemical reaction occur, producing reformer gas of the required temperature which is then injected through the blast furnace tuyere 17. Excess heat loss is avoided by providing high temperature refractory insulation, such as alumina, magnesia, or zirconia on the walls of the chamber.

Though arcing may occur between either pair of electrodes of the embodiment shown in FIG. 2, it is highly probable the the primary arcing path exists between the downstream electrodes due to the high axial gas velocity. Several means are provided to induce arcing between the center electrode and the downstream electrode 63. These include (1) control of the relative stabilizing gap dimensions, providing a smaller gap at the downstream electrode to produce downstream and initial arcing, (2) control of the relative gas flow rates through each gap, and (3) control of the relative magnetic field strengths by series/parallel connections of the field coils or adjustment in number of turns. Providing a lower gas flow rate and a lower field strength at the downstream gap will also induce breakdown and resultant arcing between the preferred electrode pair.

It has been shown in U.S. Pat. No. 3,663,792 that improved thermal efficiency and higher arc voltage can be obtained in self-stabilizing arc heaters by providing a large tangential component to the gas flow. This improvement in performance over prior art technology can be realized by providing a tangential inlet section for attachment to the upstream electrode. The vortex would be reinforced by admitting the natural gas into the electrode gaps through sonic swirl rings as shown in U.S. Pat. No. 3,663,792.

In commercial blast furnaces, a multiplicity of tuyeres are employed, ranging in number from as few as three for very small furnaces to over forty for very large installations. In instances where groups of three electric arc fired reformer tuyeres can be utilized, the units may be operated in the transferred arc operating mode. In this instance, the shortest possible downstream electrodes would be used, and the downstream arc roots induced to attach to the molten iron bath. The current path would be completed by arcing from the molten iron to the upstream electrodes of the arc heaters connected to the remaining phases of the electrical system. This operating mode would have the advantage of improved thermal efficiency resulting from reduced heat losses to the downstream electrodes.

While primarily directed to use on blast furnaces, it is recognized that this invention has potential application for all high temperature process units which require connection of piping to both electrodes of an arc heater.

What is claimed is:

1. A blast furnace for reducing metal ore to a metal, comprising:

(a) a vertical tubular refractory shell forming an upper reduction zone and a lower hearth, the shell being adapted to contain a charge metal ore and ore reactants;

(b) means for injecting a gaseous mixture into the zone and comprising at least one arc heater;

(c) the arc heater having axially spaced, generally cylindrical electrodes forming a narrow gap therebetween and adapted to be connected to a source potential to produce an arc therein;

(d) the electrodes forming an arc chamber and one of the electrodes extending through the refractory shell and communicating the arc chamber with said zone;

(e) gas inlet means communicating with the gap for introducing through the gap a reducing gas selected from the group consisting of hydrocarbon gas, liquid petroleum gas, and mixtures thereof into the arc chamber to form an arc-heated gas stream; and (f) second gas inlet means for introducing a quantity of oxygen-containing gas into the arc-heated gas stream in an amount generally equal to a stoichiometric mixture with reducing gas and the ore reactants to produce a maximum amount of carbon monoxide to effect reduction of the metal ore to elemental metal.

2. The blast furnace of claim 1 wherein the reducing gas is a hydrocarbon gas.

3. The blast furnace of claim 1 wherein the oxygen-containing gas is air.

4. The blast furnace of claim 1 wherein the reducing gas is hydrocarbon gas and the oxygen-containing gas is air.

5. The blast furnace of claim 4 wherein the metal ore is iron ore.

6. The blast furnace of claim 1 wherein there are three cylindrical electrodes with a narrow gap between each adjacent pair of electrodes.

7. The blast furnace of claim 6 in which the upstream and downstream electrodes are grounded and the intermediate electrode is connected to an electric potential.

8. The blast furnace of claim 1 in which the second gas inlet means comprises a gas-swirling structure communicating with the upstream end of the arc chamber to effect a spiral-like motion of the gas through the arc chamber.

9. The blast furnace of claim 1 in which the oxygen-containing gas is preheated to a temperature of from about 500° to 1300° C.

10. A method for operating an iron blast furnace comprising the steps of:

(a) providing a vertical tubular refractory shell forming an upper reduction zone and a lower hearth adapted to contain a charge comprising iron ore, (b) mounting an arc heater on the shell and having axially spaced cylindrical electrodes forming a narrow gap therebetween and forming an arc chamber, (c) extending one of the electrodes through the shell for communicating the arc chamber with the reduction zone, (d) striking an electric arc in the gap, (e) injecting through the gap a reducing gas selected from the group consisting of hydrocarbon gas, liquid petroleum gas, and mixtures thereof, into the arc chamber to form an elongated arc-heated gas stream extending downstream in said one electrode, (f) introducing an oxygen-containing gas into the arc-heated gas stream in an amount sufficient to produce a maximum amount of carbon monoxide to effect reduction of the iron ore to elemental metal.

11. The method of claim 10 wherein the oxygen-containing gas is introduced into the upstream end of the arc chamber in a swirling path of travel.

12. The method of claim 11 wherein the oxygen containing gas is heated to a temperature of from about 500° to 1300° C.

* * * * *

UNITED STATES PATENT AND TRADEMARK OFFICE

CERTIFICATE OF CORRECTION

PATENT NO. : 4,247,732

DATED : January 27, 1981

INVENTOR(S) : Maurice G. Fey

It is certified that error appears in the above-identified patent and that said Letters Patent is hereby corrected as shown below:

Column 3, line 43, "F" should read -- C --.

Figure 2, should appear as shown on the attached sheet.

Signed and Sealed this

*Third* Day of *August 1982*

[SEAL]

*Attest:*

GERALD J. MOSSINGHOFF

*Attesting Officer*

*Commissioner of Patents and Trademarks*